US010582761B2

(12) United States Patent
Jimenez et al.

(10) Patent No.: US 10,582,761 B2
(45) Date of Patent: Mar. 10, 2020

(54) ORAL CARE IMPLEMENT AND METHOD OF FORMING AN ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Douglas Hohlbein, Hopewell, NJ (US); Anthony Baxter, Upper Montclair, NJ (US); Marisol Rodriguez, New York, NY (US); Alberto Mantilla, Rego Park, NY (US); Ellis Junior Smith, New York, NY (US); Chad Leighton Helland, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 22 days.

(21) Appl. No.: 15/768,764

(22) PCT Filed: Oct. 22, 2015

(86) PCT No.: PCT/US2015/056948

§ 371 (c)(1),
(2) Date: Apr. 16, 2018

(87) PCT Pub. No.: WO2017/069764

PCT Pub. Date: Apr. 27, 2017

(65) Prior Publication Data

US 2018/0303231 A1 Oct. 25, 2018

(51) Int. Cl.
*A46B 5/00* (2006.01)
*A46B 9/04* (2006.01)
(Continued)

(52) U.S. Cl.
CPC ..... *A46B 5/0029* (2013.01); *A46B 7/06* (2013.01); *A46B 9/04* (2013.01); *A46B 9/06* (2013.01);
(Continued)

(58) Field of Classification Search
CPC ..... A46B 5/0029; A46B 7/06; A46B 9/04; A46B 9/06; A46B 9/065; A46B 9/10; A46B 3/20; A46B 2200/1066
See application file for complete search history.

(56) References Cited

U.S. PATENT DOCUMENTS 2,279,355 A 4/1942 Wilensky
4,691,405 A * 9/1987 Reed ..... A46B 5/0025 15/167.1
(Continued)

FOREIGN PATENT DOCUMENTS

DE 4122524 2/1992
DE 102006033412 1/2008
(Continued)

OTHER PUBLICATIONS

International Search Report and Written Opinion of the International Searching Authority in International Application No. PCT/US2015/056948, dated Aug. 9, 2016.

*Primary Examiner* — Weilun Lo

(57) ABSTRACT

An oral care implement having movable and fixed tooth cleaning elements. The oral care implement may include a handle and a head coupled to the handle. The head may include a base that is coupled to the handle and a resilient bridge coupled to the base. The resilient bridge may be flexible between a normal state in which a portion of the resilient bridge is spaced from the base by a gap and a flexed state in which a portion of the resilient bridge is moved toward the base. Tooth cleaning elements may be coupled to the resilient bridge. Furthermore, the resilient bridge may
(Continued)

include one or more apertures through which tooth cleaning elements that are fixed to the base may extend.

20 Claims, 12 Drawing Sheets

(51) Int. Cl.
*A46B 9/06* (2006.01)
*A46B 7/06* (2006.01)
*A46B 9/10* (2006.01)
*A46B 3/20* (2006.01)

(52) U.S. Cl.
CPC ..... *A46B 9/065* (2013.01); *A46B 9/10* (2013.01); *A46B 3/20* (2013.01); *A46B 2200/1066* (2013.01)

(56) References Cited

U.S. PATENT DOCUMENTS 4,694,844 A * 9/1987 Berl ..... A46B 3/00 132/308
5,201,091 A 4/1993 Tarrson et al.
6,408,473 B1 6/2002 Kessler
6,681,436 B2 1/2004 Nilsson
6,988,777 B2 1/2006 Pfenniger et al.
D576,798 S 9/2008 Moskovich
D581,164 S 11/2008 Moskovich
D581,165 S 11/2008 Moskovich
D581,166 S 11/2008 Moskovich
D581,167 S 11/2008 Moskovich
D582,162 S 12/2008 Moskovich
D582,163 S 12/2008 Moskovich
7,600,288 B1 * 10/2009 Givonetti ..... A46B 5/0029 15/167.1
7,614,111 B2 10/2009 Waguespack
7,841,041 B2 11/2010 Waguespack
7,845,042 B2 12/2010 Moskovich
D637,003 S 5/2011 Moskovich
D637,400 S 5/2011 Moskovich
7,975,346 B2 7/2011 Waguespack
8,151,397 B2 4/2012 Moskovich et al.
8,220,102 B2 7/2012 Clos et al.
8,393,042 B2 3/2013 Waguespack
8,499,402 B1 8/2013 Arsenault
8,561,247 B2 10/2013 Waguespack
8,800,093 B2 8/2014 Moskovich et al.
8,839,481 B2 9/2014 Waguespack
8,876,221 B2 11/2014 Hohlbein
9,185,967 B2 11/2015 Geiberger
9,504,312 B2 11/2016 Brown, Jr. et al.
9,545,148 B2 1/2017 Moskovich
2002/0152570 A1 * 10/2002 Hohlbein ..... A46B 5/002 15/167.1
2007/0067933 A1 * 3/2007 Waguespack ..... A46B 5/0029 15/167.1
2012/0204370 A1 * 8/2012 Crossman ..... A46B 7/06 15/167.1
2015/0000063 A1 1/2015 Moskovich et al.
2017/0099938 A1 4/2017 Moskovich

FOREIGN PATENT DOCUMENTS

DE 202011106118 U 11/2011
EP 454625 10/1991

* cited by examiner 190
130
140
133
139
134
138
132
151
164
157
165
158
173
150
159
185
152

190
130
150
185
116

190
130
117b
139
117a
138
116
116
150
173
185
174
186

ORAL CARE IMPLEMENT AND METHOD OF FORMING AN ORAL CARE IMPLEMENT

BACKGROUND

The conventional toothbrush is typically provided with tooth cleaning elements such as bristles which are fixed in orientation at a single angle and height with respect to the head of the brush. While this may be appropriate for general purpose cleansing of tooth surfaces, it is desirable to provide a toothbrush which has flexibility and adjustability to enhance the effectiveness of the brushing regimen and oral health.

BRIEF SUMMARY

The present invention may be directed, in one aspect, to an oral care implement having a handle and a head coupled to the handle. The head may include a base that is coupled to the handle and a resilient bridge. The resilient bridge may be coupled to the base. The resilient bridge may be flexible between a normal state in which a portion of the resilient bridge is spaced from the base by a gap and a flexed state in which a portion of the resilient bridge is moved toward the base and into the gap. The resilient bridge may be self-biased into the normal state under flexure stress. Tooth cleaning elements may be coupled to the resilient bridge. Furthermore, the resilient bridge may include one or more apertures through which tooth cleaning elements that are fixed to the base may extend.

In one aspect, the invention may be an oral care implement comprising: a handle; a head coupled to the handle and extending along a longitudinal axis, the head comprising: a base; a resilient bridge flexible between: (1) a normal state in which the resilient bridge comprises a bowed section that is bowed away from the base so that a gap exists between a lower surface of the resilient bridge and an upper surface of the base; and (2) a flexed state in which the bowed section of the resilient bridge is moved toward the base and into the gap; and the resilient bridge being self-biased into the normal state, and wherein in the normal state, the bowed section of the resilient bridge is under flexure stress; a plurality of movable tooth cleaning elements mounted to the resilient bridge and extending from an upper surface of the resilient bridge; and a first fixed tooth cleaning element mounted to the base and having a free end, the first fixed tooth cleaning element extending through a first aperture in the resilient bridge.

In another aspect, the invention may be an oral care implement comprising: a handle; a head coupled to the handle, the head comprising: a base; a resilient bridge coupled to the base and supported above the base, the resilient bridge flexible between: (1) a normal state in which a gap exists between a lower surface of the resilient bridge and an upper surface of the base; and (2) a flexed state in which a portion of the resilient bridge is moved toward the base and into the gap; a loop of movable tooth cleaning elements mounted to the portion of the resilient bridge and extending from an upper surface of the resilient bridge, the loop of movable tooth cleaning elements collectively defining a central cavity having a floor, a first aperture in the floor extending through the resilient bridge from the lower surface of the resilient bridge to the upper surface of the resilient bridge; and a first fixed tooth cleaning element mounted to the base and having a free end, the first fixed tooth cleaning element extending through the first aperture and into the central cavity.

In yet another aspect, the invention may be an oral care implement comprising: a handle; a head coupled to the handle and extending along a longitudinal axis, the head comprising: a base having a proximal end coupled to a distal end of the handle and a distal end; a resilient bridge comprising: at least one carrier section; a curved portion having a convex outer surface, a concave inner surface, a lower end coupled to the distal end of the base and an upper end coupled to the at least one carrier section; a second end coupled to the distal end of the handle; the resilient bridge flexible between: (1) a normal state in which a gap exists between a lower surface of the resilient bridge and an upper surface of the base; and (2) a flexed state in which the curved portion is deformed such that a portion of the resilient bridge is moved toward the base and into the gap; and a plurality of movable tooth cleaning elements mounted to the at least one carrier section of the resilient bridge and extending from an upper surface of the resilient bridge.

In a further aspect, the invention may be a method of forming an oral care implement comprising: a) providing a body comprising a base and a bridge extending from a distal end of the base, the bridge terminating in a free end; b) mounting a plurality of tooth cleaning elements to the bridge; c) bending the bridge toward a proximal end of the base; and d) coupling the free end of the bridge to a proximal end of the base, thereby forming a head of an oral care implement.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
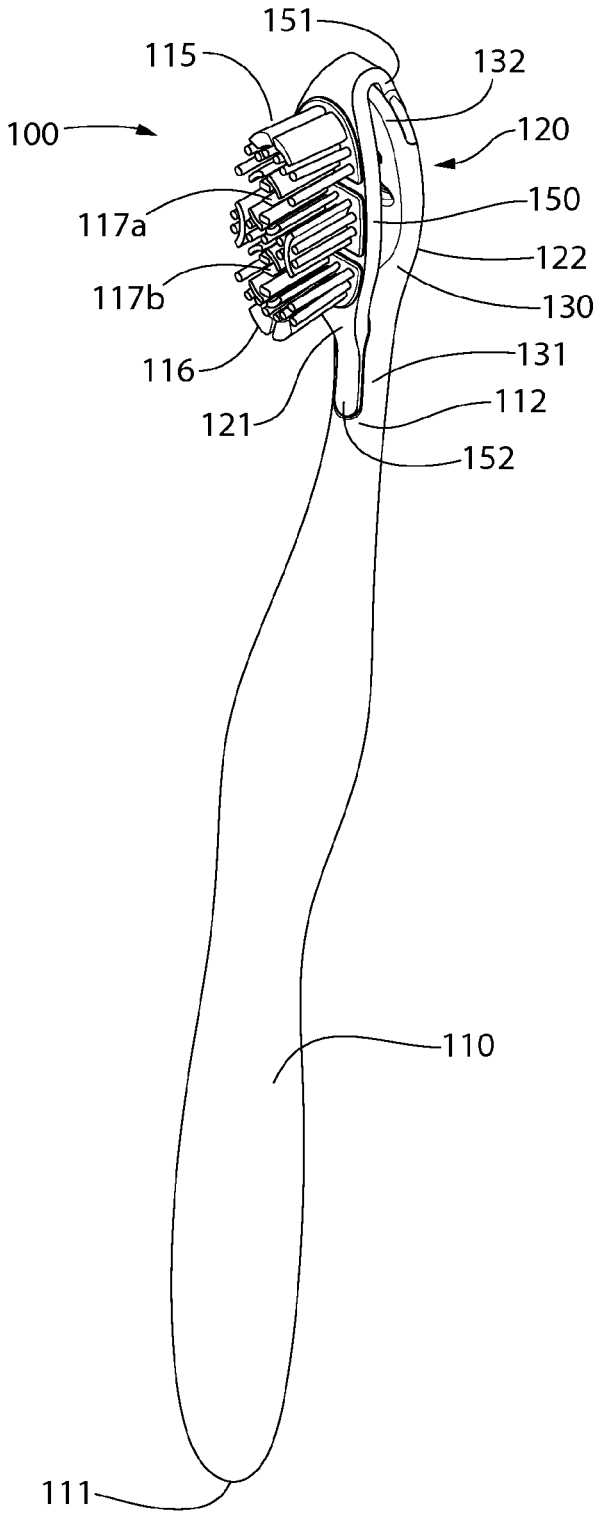
FIG. 1 is a front perspective view of an oral care implement having a handle and a head in accordance with an embodiment of the present invention.
Figure 2:
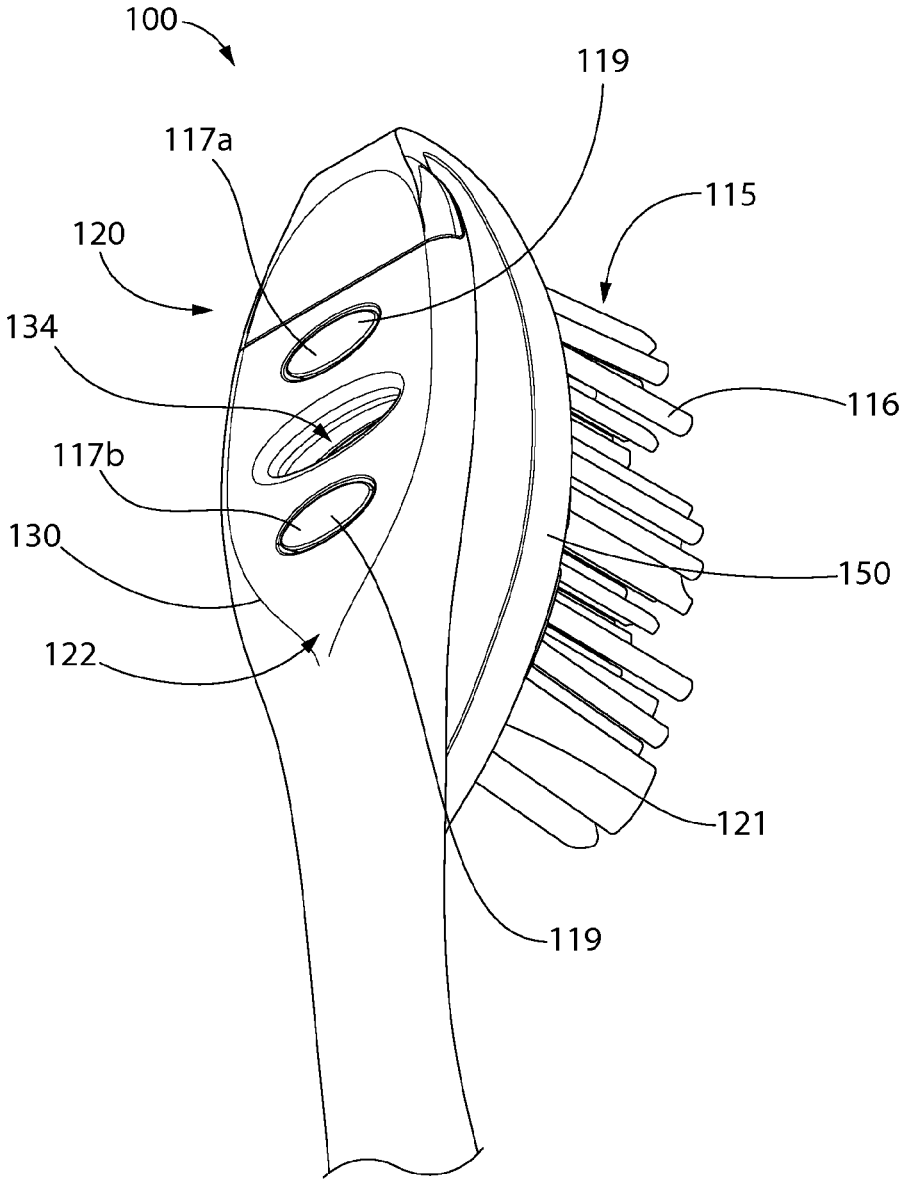
FIG. 2 is a rear perspective view of the head of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIGS. 1-4 concurrently, an oral care implement 100 will be described in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 100 generally comprises a handle 110 and a head 120. The handle 110 extends from a proximal end 111 to a distal end 112. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

In the exemplified embodiment, the handle 110 is formed of a rigid plastic material, such as for example without limitation polymers and copolymers of ethylene, propylene, butadiene, vinyl compounds, and polyesters such as polyethylene terephthalate. Of course, materials other than those noted above can be used to form the handle 110, including metal, wood, or any other desired material that has sufficient structural rigidity to permit a user to grip the handle 110 and manipulate the oral care implement 100 during toothbrushing. Although not illustrated in the exemplified embodiment, the handle 110 may also include a grip that is formed of a resilient/elastomeric material. Such a grip may be coupled to or molded over a portion of the handle 110 that is typically gripped by a user's thumb and forefinger during use and/or over portions of the handle that are typically gripped by a user's palm during use to increase comfort to a user.

The head 120 of the oral care implement 100 is coupled to the handle 110 and has a front surface 121 and an opposing rear surface 122. The head 120 of the oral care implement 100 extends along a longitudinal axis A-A. In some embodiments the head 120 may be formed integrally with the handle 110 as a single unitary structure using a molding, milling, machining, or other suitable process. In other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 120 may, in certain embodiments, be formed of any of the rigid plastic materials described above as being used for forming the handle 110, although the invention is not to be so limited in all embodiments and other materials that are commonly used during toothbrush head manufacture may also be used.

The oral care implement 100 also comprises a plurality of tooth cleaning elements 115 extending from the front surface 121 of the head 120. As will be discussed in more detail below, the plurality of tooth cleaning elements 115 comprise a plurality of movable tooth cleaning elements 116 and one or more fixed tooth cleaning elements 117. Where it does not conflict with the disclosure below, the invention is not to be limited by the structure, pattern, orientation, and material of the tooth cleaning elements 115 in all embodiments. Furthermore, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning elements 115 in some embodiments.

In embodiments that use elastomeric materials to form one or more of the tooth cleaning elements 115, suitable elastomeric materials may include any biocompatible resilient material suitable for uses in an oral hygiene apparatus.

To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 115 may be coupled to the head 120 in any manner known in the art, including staples, in-mold tufting (IMT), anchor-free tufting (AFT), or a modified AFT known as AMR. The details of using AFT as the tooth cleaning element coupling technique will be described in more detail below with reference to the exemplified embodiment and FIGS. 7A-7F.

Although not illustrated in the exemplified embodiment, the head 120 of the oral care implement 100 may include a soft tissue cleanser coupled to or positioned on the rear surface 122 of the head 120. An example of one suitable tissue cleanser that may be used with the present invention and positioned on the rear surface 122 of the head 120 is disclosed in U.S. Pat. No. 7,143,462, issued Dec. 5, 2006 to the assignee of the present application, the entirety of which is hereby incorporated by reference. Such a soft tissue cleanser may include protuberances, which can take the form of elongated ridges, nubs, or combinations thereof. Of course, in certain embodiments the oral care implement 100 may not include any soft tissue cleanser such as in the exemplified embodiment.

Figure 3:
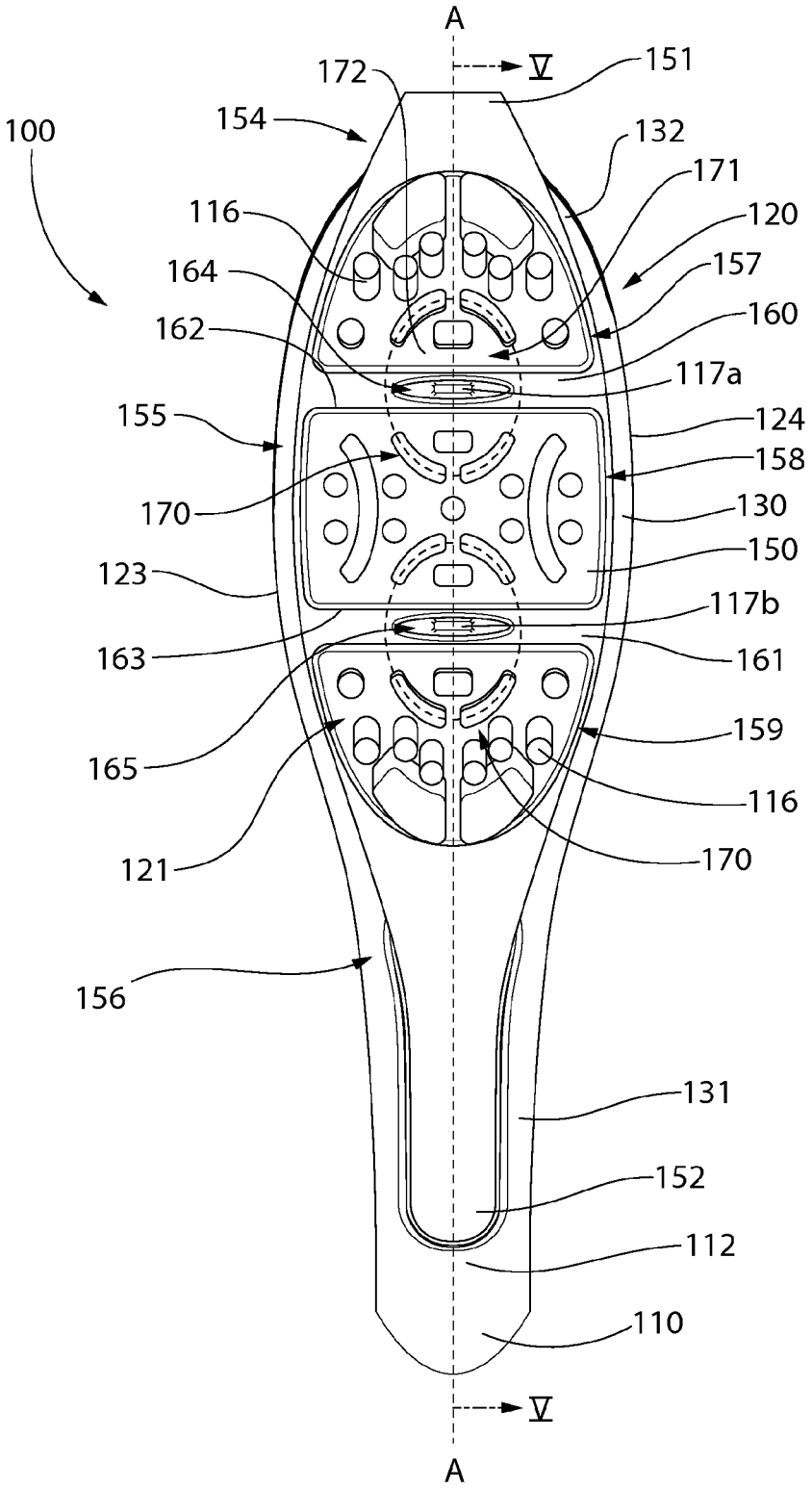
FIG. 3 is a front view of the head of FIG. 1.
Figure 4:
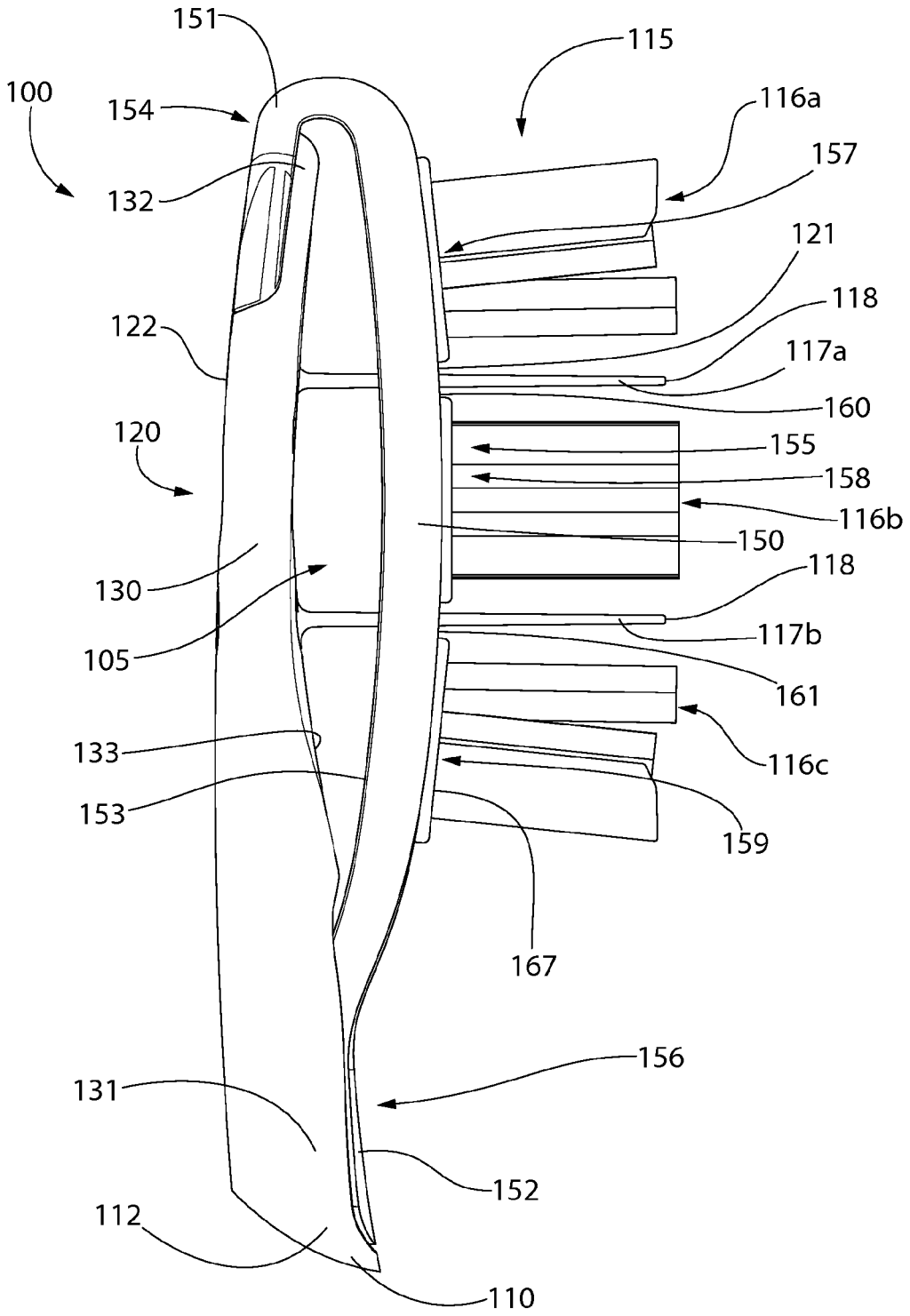
FIG. 4 is a side view of the head of FIG. 1.

Still referring to FIGS. 1-4 collectively, the head 120 of the oral care implement 100 will be further described. In the exemplified embodiment, the head 120 generally comprises a base 130 and a resilient bridge 150. The resilient bridge 150 is coupled to the base 130 to form the head 120. Specifically, the resilient bridge 150 is coupled to the base 130 and to the handle 110 in such a manner that a lower surface 153 of the resilient bridge 150 is spaced apart from an upper surface 133 of the base 130 by a gap 105, as best illustrated in FIG. 4. Although the phrase "coupled to" is used to describe the relationship between the resilient bridge 150 and the base 130, as described herein in certain embodiments the resilient bridge 150 or portions thereof may be integrally formed with the base 130. In the exemplified embodiment, the gap 105 forms a transverse passageway that extends through the head 120 from a first peripheral outer surface or first lateral surface 123 of the head 120 to a second peripheral outer surface or second lateral surface 124 of the head 120, the second peripheral outer surface 124 being located opposite to the first peripheral outer surface 123.

The base 130 extends from a proximal end 131 to a distal end 132. Specifically, the proximal end 131 of the base 130 is coupled to the distal end 112 of the handle 110. In the exemplified embodiment the base 130 of the head 120 is formed integrally with the handle 110 although the base 130 of the head 120 may be separately formed from and later connected to the handle 110 in other embodiments. The resilient bridge 150 of the head 120 extends from a first end 151 to a second end 152. The first end 151 of the resilient bridge 150 is coupled to the distal end 132 of the base 130 and the second end 152 of the resilient bridge 150 is coupled to the distal end 112 of the handle 110. As will be described in more detail below, in certain embodiments at least a portion of the resilient bridge 150 may be integrally formed with the handle 110 and the base 130 of the head 120, although this is not required in all embodiments. Specifically, in certain embodiments the first end 151 of the resilient bridge 150 may be integrally formed with the distal end 132 of the base 130 and the second end 152 of the resilient bridge 150 may be coupled to the distal end 112 of the handle during the manufacturing process using mechanical means such as ultrasonic welding, adhesion, fasteners, or the like. This process will be described in more detail below with reference to FIGS. 7A-7F.

Referring to FIGS. 2-6 concurrently, the relationship between and specific details of the base 130 and the resilient bridge 150 will be described in more detail. As noted above, the resilient bridge 150 is coupled to the base 130 in such a manner that the resilient bridge 150 and the base 130 are spaced apart by the gap 105. The resilient bridge 150 comprises a U-shaped distal section 154, a middle section 155, and a proximal section 156. The U-shaped distal section 154 of the resilient bridge 150 comprises the first end 151 of the resilient bridge 150 and defines a distal-most peripheral outer surface of the head 120 that is free of an overhang. Thus, the U-shaped distal section 154 of the resilient bridge 150 forms a U-shaped distal end of the head 120.

Described another way, the U-shaped distal section 154 of the resilient bridge 150 may be referred to herein as a curved portion of the resilient bridge 150. The curved portion or U-shaped distal section 154 of the resilient bridge 150 comprises a convex outer surface 181, a concave inner surface 182, a lower end 183 that is coupled to the distal end 132 of the base 130, and an upper end 184 that is coupled to at least one carrier section (the carrier sections are described in more detail below and are denoted as reference numerals 157-159) of the resilient carrier 150. The concave inner surface 182 of the curved portion or U-shaped distal section 154 of the resilient bridge 150 faces the gap 105. The convex outer surface 181 of the curved portion or U-shaped distal section 154 of the resilient bridge 150 forms or comprises the distal-most portion of the head 120. The resilient bridge 150, or the U-shaped distal section 154 (i.e., curved portion) thereof, forms the distal-most end of the head 120. The U-shaped distal section 154 forms a hinge-like structure at the distal end of the head 120 between the carrier sections 157-159 of the resilient bridge 150 and the base 130.

As noted above, the movable tooth cleaning elements 116 are coupled to the resilient bridge 150. The movable tooth cleaning elements 116 are referred to herein as being movable because, as will be discussed in more detail below with specific reference to FIGS. 5 and 6, the resilient bridge 150 is movable, which in turn renders the movable tooth cleaning elements 116 movable by virtue of their being coupled to the resilient bridge 150. The resilient bridge 150 comprises a first carrier section 157, a second carrier section 158, and a third carrier section 159. In certain embodiments the first carrier section 157 may be referred to herein as a distal-most carrier section and the third carrier section 159 may be referred to herein as a proximal-most carrier section.

The first carrier section 157 is coupled the upper end 184 of the U-shaped distal section or curved section 154 of the resilient bridge 150 and to a first end 162 of the second carrier section 158 via a first flexible transverse hinge 160. The third carrier section 159 is coupled to a second end 163 of the second carrier section 158 via a second flexible transverse hinge 161. The second end 163 of the second carrier section 158 is opposite the first end 162 of the second carrier section 158 in the direction of the longitudinal axis A-A of the head 120. In the exemplified embodiment, a first group of the movable tooth cleaning elements **116*a* are mounted to the first carrier section 157, a second group of the movable tooth cleaning elements 116***b* are mounted to the second carrier section 158, and a third group of the movable tooth cleaning elements 116*c* are mounted to the third carrier section 159. In the exemplified embodiment, a lower surface of each of the first carrier section 157, the second carrier section 158, and the third carrier section 159 is spaced apart from the upper surface 133 of the base 130 by the gap 105. Stated another way, the gap 105 extends beneath the entirety of each of the first, second, and third carrier sections 157, 158, 159. Although the exemplified embodiment includes three separate carrier sections 157-159, the invention is not to be so limited and in other embodiments the resilient bridge 150 may include only two separate carrier sections or more than three separate carrier sections as desired.

Figure 5:
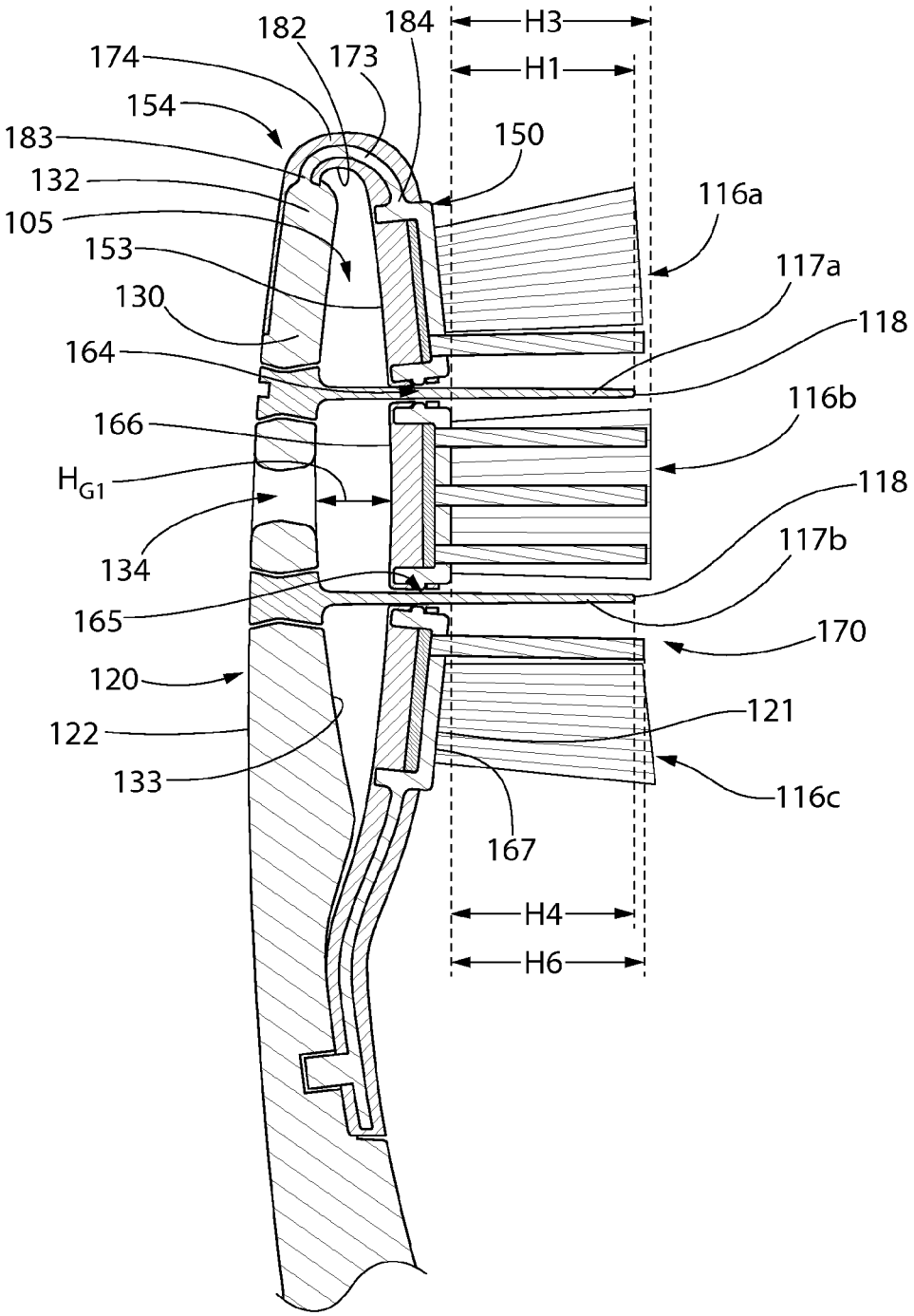
FIG. 5 is a cross-sectional view taken along line V-V in FIG. 3 with a resilient bridge of the head in a normal state.
Figure 6:
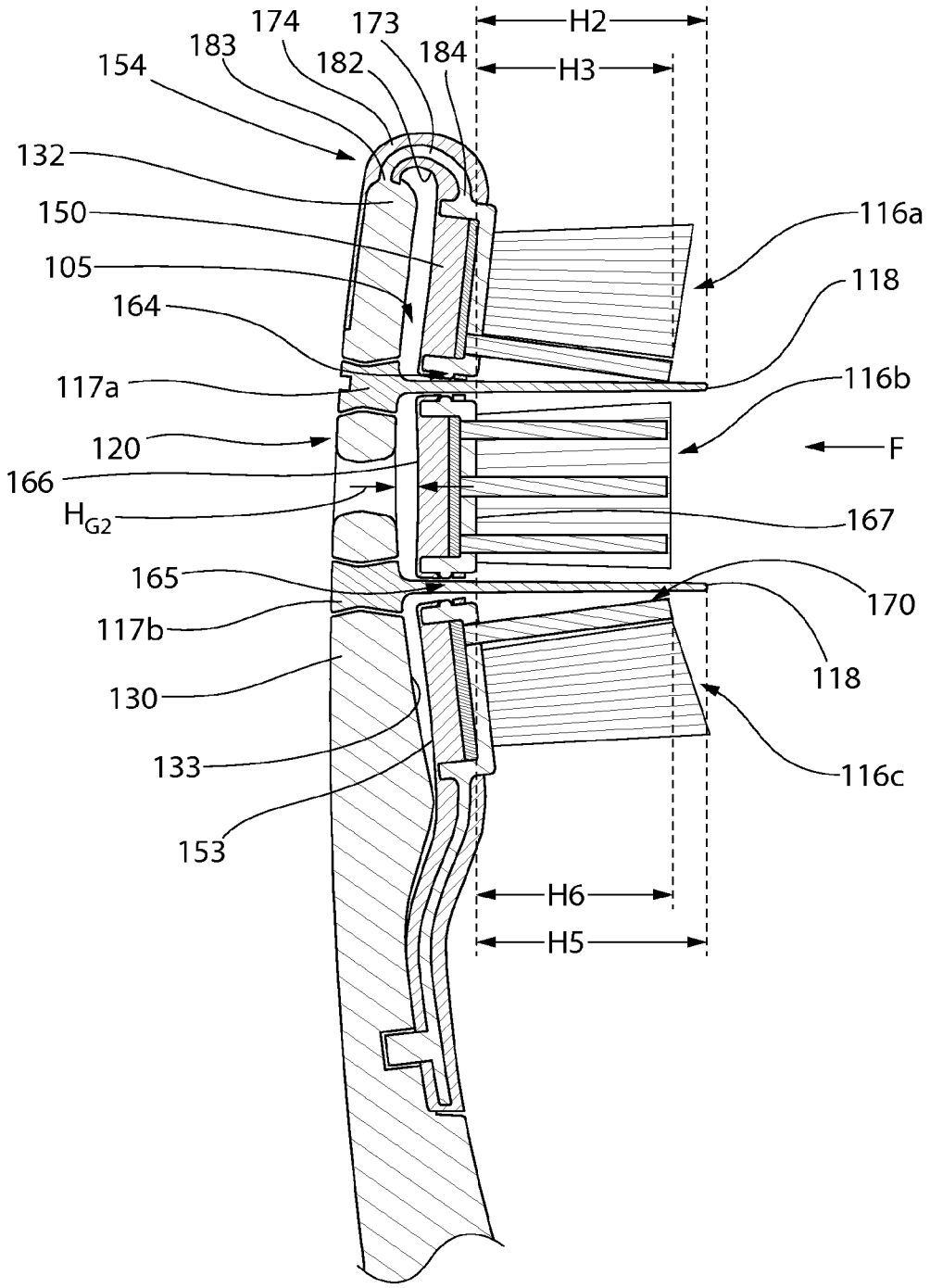
FIG. 6 is a cross-sectional view taken along line V-V in FIG. 3 with the resilient bridge of the head in a flexed state.

As can be seen in particular in FIG. 3, each of the first and second flexible transverse hinges 160, 161 spans across an entirety of a width of the resilient bridge 150. The first and second flexible transverse hinges 160, 161 may be formed by connecting the first, second, and third carrier sections 157, 158, 159 with a thin strut of a rigid material that is encased within a resilient material such as a thermoplastic elastomer. Thus, each of the first and second flexible transverse hinges 160, 161 may comprise the thin strut and the surrounding elastomeric material. The first flexible transverse hinge 160 permits the first and second carrier sections 157, 158 to flex and move relative to one another and the second flexible transverse hinge 161 permits the second and third carrier sections 158, 159 to flex and move relative to one another. The transverse hinges 160, 161 also permit the entire resilient bridge 150 to move upwardly and downwardly relative to the base 130 of the head 120. Thus, the flexibility provided by the transverse hinges 160, 161 facilitates movement or flexibility of the resilient bridge 150 between a normal state as illustrated in FIG. 5 and a flexed state as illustrated in FIG. 6, the details of which will be described in more detail below.

The base 130 of the head 120 comprises an aperture 134 that extends entirely through the base 130 from the upper surface 133 of the base 130 to the rear surface 122 of the head 120 (which is formed by a lower surface or rear surface of the base 130). The aperture 134 provides an additional degree of flexibility into the base 130 of the head 120 so that the head 120 can better adapt to the contours of a user's mouth during oral hygiene activities using the oral care implement 100. The aperture 134 may also enhance hygiene of the oral care implement 100 by permitting bacteria and other debris collected onto the head 120 of the oral care implement 100 during use to be washed away via the aperture 134. In the exemplified embodiment the aperture 134 is elongated along a width of the head 120 but may be positioned and arranged in manners that are other than those depicted in the exemplified embodiment. The aperture 134 may also be omitted in some embodiments.

Furthermore, as noted above the plurality of tooth cleaning elements 115 includes one or more fixed tooth cleaning elements 117. In the exemplified embodiment the fixed tooth cleaning elements 117 includes a first fixed tooth cleaning element 117*a* and a second fixed tooth cleaning element 117*b*. Each of the first and second fixed tooth cleaning elements 117*a*, 117*b* is mounted to the base 130. The first and second fixed tooth cleaning elements 117*a*, 117*b* are referred to as fixed because they are non-movable relative to the base 130 from which they extend. Each of the first and second fixed tooth cleaning elements 117*a*, 117*b* extends from the base 130 to a terminal end or free end 118. In the exemplified embodiment, the first and second fixed tooth cleaning elements 117*a*, 117*b* are coupled to the base 130 such that a bottom portion 119 of the first and second fixed tooth cleaning elements 117*a*, 117*b* are exposed on the rear surface 122 of the head 120. Of course, this is not required in all embodiments.

Furthermore, in the exemplified embodiment each of the first and second fixed tooth cleaning elements 117*a*, 117*b* may be an interdental element having a transverse cross-sectional area that tapers moving from the base 130 toward the free end 118 of the first and second fixed tooth cleaning elements 117*a*, 117*b*. Thus, the first and second fixed tooth cleaning elements 117*a*, 117*b* may facilitate cleaning the interproximal areas of a user's oral cavity. In the exemplified embodiment, the fixed tooth cleaning elements 117*a*, 117*b* have a rectangular cross-sectional shape and they taper to form a somewhat elongated free end 118. Of course, the invention is not limited to the cross-sectional shape illustrated in all embodiments and the fixed tooth cleaning elements 117*a*, 117*b* may be conical, cylindrical, or the like in other embodiments. Each of the first and second fixed tooth cleaning elements 117*a*, 117*b* may be formed of a thermoplastic elastomer, a rigid plastic material, wood, a single tuft of bristles, or the like as may be desired. Rubber or a thermoplastic elastomer may be a desirable material to ensure that the first and second fixed tooth cleaning elements 117*a*, 117*b* can flex and move during conventional toothbrushing and can penetrate the interproximal regions to effectively remove plaque therefrom.

In the exemplified embodiment, the first and second fixed tooth cleaning elements 117*a*, 117*b* are located on the longitudinal axis A-A of the head 120 and are spaced apart from one another. Of course, the invention is not to be so limited in all embodiments and the first and second fixed tooth cleaning elements 117*a*, 117*b* may be located offset from the longitudinal axis A-A of the head 120 in other embodiments. Furthermore, although in the exemplified embodiment there are two of the fixed tooth cleaning elements 117*a*, 117*b* illustrated, in other embodiments a single fixed tooth cleaning element 117 or more than two fixed tooth cleaning elements 117 may be provided.

In the exemplified embodiment, a first aperture 164 is formed into the first flexible transverse hinge 160 of the resilient bridge 150 located between the first and second carriers 157, 158 of the resilient bridge 150. Furthermore, in the exemplified embodiment a second aperture 165 is formed into the second flexible transverse hinge 160 of the resilient bridge 150 located between the second and third carriers 158, 159. In the exemplified embodiment, the first aperture 164 is located between the first and second carriers 157, 158 and the second aperture 165 is located between the second and third carriers 158, 159. Stated another way, the first aperture 164 is located between the first group of movable tooth cleaning elements coupled to the first carrier 157 and the second group of movable tooth cleaning elements coupled to the second carrier 158. The second aperture 165 is located between the second group of movable cleaning elements coupled to the second carrier 158 and the third group of movable cleaning elements coupled to the third carrier 159.

Although the first and second apertures 164, 165 are exemplified as being formed into the first and second flexible transverse hinges 160, 161, the invention is not to be so limited in all embodiments. The first and second apertures 164, 165 may alternatively be located within the first, second, and or third carriers 157, 158, 159 of the resilient bridge 150 if so desired. Thus, the first and second apertures 164, 165 may merely be formed into the resilient bridge 150 in some embodiments. The first and second apertures 164, 165 extend entirely through the resilient bridge 150 from the lower surface 153 of the resilient bridge 150 to the front surface 121 of the head 120 (which also forms an upper surface 167 of the resilient bridge 150).

Regardless of the specific location of the first and second apertures 164, 165, the first and second apertures 164, 165 are positioned to be aligned with the first and second fixed tooth cleaning elements 117*a*, 117*b* so that the first and second fixed tooth cleaning elements 117*a*, 117*b* extend through the first and second apertures 164, 165, respectively. Specifically, the first fixed tooth cleaning element 117*a* extends from the base 130 and through the gap 105 in a direction towards the resilient bridge 130. The first fixed tooth cleaning element 117*a* then extends through the first aperture 164 formed into the resilient bridge 130 (and specifically formed into the first flexible transverse hinge 160 in the exemplified embodiment). Similarly, the second fixed tooth cleaning element 117*b* extends from the base 130 and through the gap 105 in a direction towards the resilient bridge 130. The second fixed tooth cleaning element 117*b* then extends through the second aperture 165 formed into the resilient bridge 130 (and specifically formed into the second flexible transverse hinge 161 in the exemplified embodiment). It should be appreciated that in some embodiments the first and second fixed tooth cleaning elements 117*a*, 117*b* and/or the first and second apertures 164, 165 may be omitted.

In the exemplified embodiment, the first aperture 164 has an elongated oval transverse cross-sectional shape such that the first aperture 164 has a width that is two to four times greater than a width of the first fixed tooth cleaning element 117*a* (the widths being measured in a direction transverse to the longitudinal axis A-A). The first aperture 164 also has a length that is approximately one to three times greater than a length of the first fixed tooth cleaning element 117*a* (the lengths being measured along or in the direction of the longitudinal axis A-A). Forming the first aperture 164 to be larger than the first fixed tooth cleaning element 117*a* provides additional space within the first aperture 164 for the first fixed tooth cleaning element 117*a* to extend through such that the first fixed tooth cleaning element 117*a* can still extend through the first aperture 164 even if it becomes bent, splayed, or the like over time.

Furthermore, as noted above the resilient bridge 150 is flexible such that it can move towards and away from the base 130 into the gap 105 during use (described in more detail below). By sizing and shaping the first aperture 164 relative to the first fixed tooth cleaning element 117*a* as described herein and illustrated in the drawings, the first fixed tooth cleaning element 117*a* will remain extending through the first aperture 164 even if the resilient bridge 150 is tilted or angled relative to the base 130 during use. Although the relationship between the first aperture 164 and the first fixed tooth cleaning element 117*a* is described in detail herein, it should be appreciated that the same relationship exists between the second aperture 165 and the second fixed tooth cleaning element 117*b*.

Referring briefly to FIG. 3, although the pattern and arrangement of the movable tooth cleaning elements 116 is not to be limiting of the present invention in all embodiments, in certain embodiments the movable tooth cleaning elements 116 comprises a loop 170 of the movable tooth cleaning elements 116. The loop 170 is formed by a plurality of the movable cleaning elements 116 that are arranged in a ring or loop about an axis. In the exemplified embodiment the loop 170 is oval-shaped, but the loop may be circular in other embodiments. Alternatively, the loop 170 may be a square or other shape. Regardless, the loop 170 forms a noticeable ring about an axis. The loop 170 defines a central cavity 171 having a floor 172. In the exemplified embodiment, the first aperture 164 is formed into and located on the floor 172 of the central cavity 171. Thus, the first fixed tooth cleaning element 117*a* extends through the first aperture 164 and into the central cavity 171 of the loop 170. Thus, the loop 170 surrounds the aperture 164 and the first fixed tooth cleaning element 117*a*. A similar loop 170 surrounds the aperture 165 and the second fixed tooth cleaning element 117*b*.

In the exemplified embodiment, the loop 170 is formed by two arcuate cleaning elements located on the first carrier section 157 and two arcuate cleaning elements located on the second carrier section 158. Specifically, the two arcuate cleaning elements located on the first carrier section 157 have arcuate surfaces that face the second carrier section 158 and the two arcuate cleaning elements located on the second carrier section 158 have arcuate surfaces that face the first carrier section 157. Of course, the loop 170 may be entirely located on one of the first, second, and third carrier sections 157, 158, 159 in other embodiments, particularly in embodiments that have the aperture 164 located on one of the respective carrier sections.

Referring to FIGS. 5 and 6 concurrently, the movement or flexibility of the resilient bridge 150 will be described. As noted above, the resilient bridge 150 is flexible between: (1) a normal state, illustrated in FIG. 5, in which the resilient bridge 150 comprises a bowed section 166 that is bowed away from the base 130 so that the gap 105 exists between the lower surface 153 of the resilient bridge 150 and the upper surface 133 of the base 130; and (2) a flexed state, illustrated in FIG. 6, in which the bowed section 166 of the resilient bridge 150 is moved downwardly into the gap 105 and towards the base 130. The resilient bridge 150 is self-biased into the normal state such that without any external forces being applied to the resilient bridge 150, the resilient bridge 150 will be in the normal state illustrated in FIG. 5. Furthermore, in the normal state, the bowed section 166 of the resilient bridge 150 is under flexure stress. Specifically, the bowed section 166 of the resilient bridge 150 is bowed in the normal state due to the manner in which the resilient bridge 150 is folded about the base 120 and coupled to the handle 110. The movable tooth cleaning elements 116 are movable due to their attachment to the resilient bridge 150 which is movable as described herein. The resilient bridge 150 flexes into the flexed state upon application of a force F onto the resilient bridge 150 in the direction of the base 130 that is sufficient to overcome the self-biasing force of the resilient bridge 150.

In the exemplified embodiment, when the resilient bridge 150 is in the normal state, the lower surface 153 of the resilient bridge 150 is concave in the longitudinal direction and the upper surface 167 of the resilient bridge 150 is convex in the longitudinal direction. Furthermore, in the exemplified embodiment when the resilient bridge 150 is in the flexed state, the lower surface 153 of the resilient bridge 150 is convex in the longitudinal direction and the upper surface 167 of the resilient bridge is concave in the longitudinal direction. Of course, the invention is not to be limited as such in all embodiments. Furthermore, although the upper and lower surfaces 153, 167 of the resilient bridge 150 are concave and convex in the longitudinal direction, in certain embodiments the upper and lower surfaces 153, 167 of the resilient bridge is planar along any transverse plane taken through the resilient bridge 150.

When the resilient bridge 150 is in the normal state, the gap 105 has a first maximum gap height $H_{G1}$ measured between the upper surface 133 of the base 130 and the lower surface 153 of the resilient bridge 150. When the resilient bridge 150 is in the flexed state, the gap 105 has a second maximum gap height $H_{G2}$ measured between the upper surface 133 of the base 130 and the lower surface 153 of the resilient bridge 150. The first maximum gap height $H_{G1}$ is greater than the second maximum gap height $H_{G2}$. In the exemplified embodiment, the gap 105 still exists when the resilient bridge 150 is in the flexed state, although it is smaller than when the resilient bridge 150 is in the normal state. In some embodiments the gap 105, or a portion thereof, may be eliminated when the resilient bridge 150 is in the flexed state such that the lower surface 153 of the resilient bridge 150 (or a portion thereof) may be in direct surface contact with the upper surface 133 of the base 133.

Still referring to FIGS. 5 and 6, when the resilient bridge 150 is in the normal state, the free end 118 of the first fixed tooth cleaning element 117*a* is located a first height H1 above the upper surface 167 of the resilient bridge 150. When the resilient bridge 150 is in the flexed state, the free end 118 of the first fixed tooth cleaning element 117*a* is located a second height H2 above the upper surface 167 of the resilient bridge 150. As can be seen in a comparison of FIGS. 5 and 6, the second height H2 is greater than the first height H1. This occurs due to the resilient bridge 150 moving downwardly towards the base 130 when transitioning between the normal and flexed states and due to the first fixed tooth cleaning element 117*a* not moving when the resilient bridge 150 moves due to their being coupled directly to the base 130.

Similarly, when the resilient bridge 150 is in the normal state, the free end 118 of the second fixed tooth cleaning element 117*b* is located a fourth height H4 above the upper surface 167 of the resilient bridge 150. When the resilient bridge 150 is in the flexed state, the free end 118 of the second fixed tooth cleaning element 117*b* is located a fifth height H5 above the upper surface 167 of the resilient bridge 150. As can be seen in a comparison of FIGS. 5 and 6, the fifth height H5 is greater than the fourth height H4. Furthermore, in the exemplified embodiment a tallest one of the plurality of movable bristles 116 has a third height H3 measured from the upper surface 167 of the resilient bridge to a free end of the tallest one of the plurality of movable bristles 116. In the exemplified embodiment the first and fourth heights H1, H4 are less than the third height H3 and the second and fifth heights H2, H5 are greater than the third height H3.

Furthermore, in the exemplified embodiment the loop 170 has a sixth height H6 measured from the upper surface 167 of the resilient bridge to a free end of the loop 170. The sixth height H6 of the loop 170 is greater than the first height H1 of the first fixed tooth cleaning element 117*a* (and also the fourth height H4 of the second fixed tooth cleaning element 117*b*) and the sixth height H6 of the loop 170 is less than the second height H2 of the first fixed tooth cleaning element 117*b* (and also the fifth height H5 of the second fixed tooth cleaning element 117*b*). Thus, when the resilient bridge 150 is in the normal state, the loop is taller than the first and second fixed tooth cleaning elements 117*a*, 117*b*. When the resilient bridge 150 is in the flexed state, the loop is shorter than the first and second fixed tooth cleaning elements 117*a*, 117*b*. This occurs as a result of the resilient bridge 150, and also the cleaning elements coupled thereto which includes the tooth cleaning elements that form the loop 170, moving downwardly towards the base 130 as the resilient bridge 150 flexes from the normal state to the flexed state.

Still referring to FIGS. 5 and 6, in the exemplified embodiment the resilient bridge 150 is a multi-component plate structure. Specifically, the resilient bridge 150 comprises a first component 173 formed of a first material and a second component 174 formed of a second material, the first and second materials being different. In the exemplified embodiment, the first component 173 is formed integrally with the base 130 of the head 120 (and also with the handle 110). Thus, in certain embodiments the first component 173 and the base 130 of the head 120 may be integrally formed via an injection molding process. The first component 173 and the base 130 may, in certain embodiments, be a rigid plastic material such as for example without limitation polymers and copolymers of ethylene, propylene, butadiene, vinyl compounds, and polyesters such as polyethylene terephthalate. The second component 174 may be a softer or more flexible material such as a thermoplastic elastomer or other rubber-like material. The second component 174 may be injection molded onto the first component 173 in a separate injection molding process as described herein below. The first component 173 may be sufficiently thin to permit the resilient bridge 150 to be bent to form the U-shaped distal section 154. The bending of the resilient bridge 150 will be described in more detail directly below with regard to the method of forming the oral care implement and with reference to FIGS. 7A-7F.

Figures 7A, 7B, 7C:
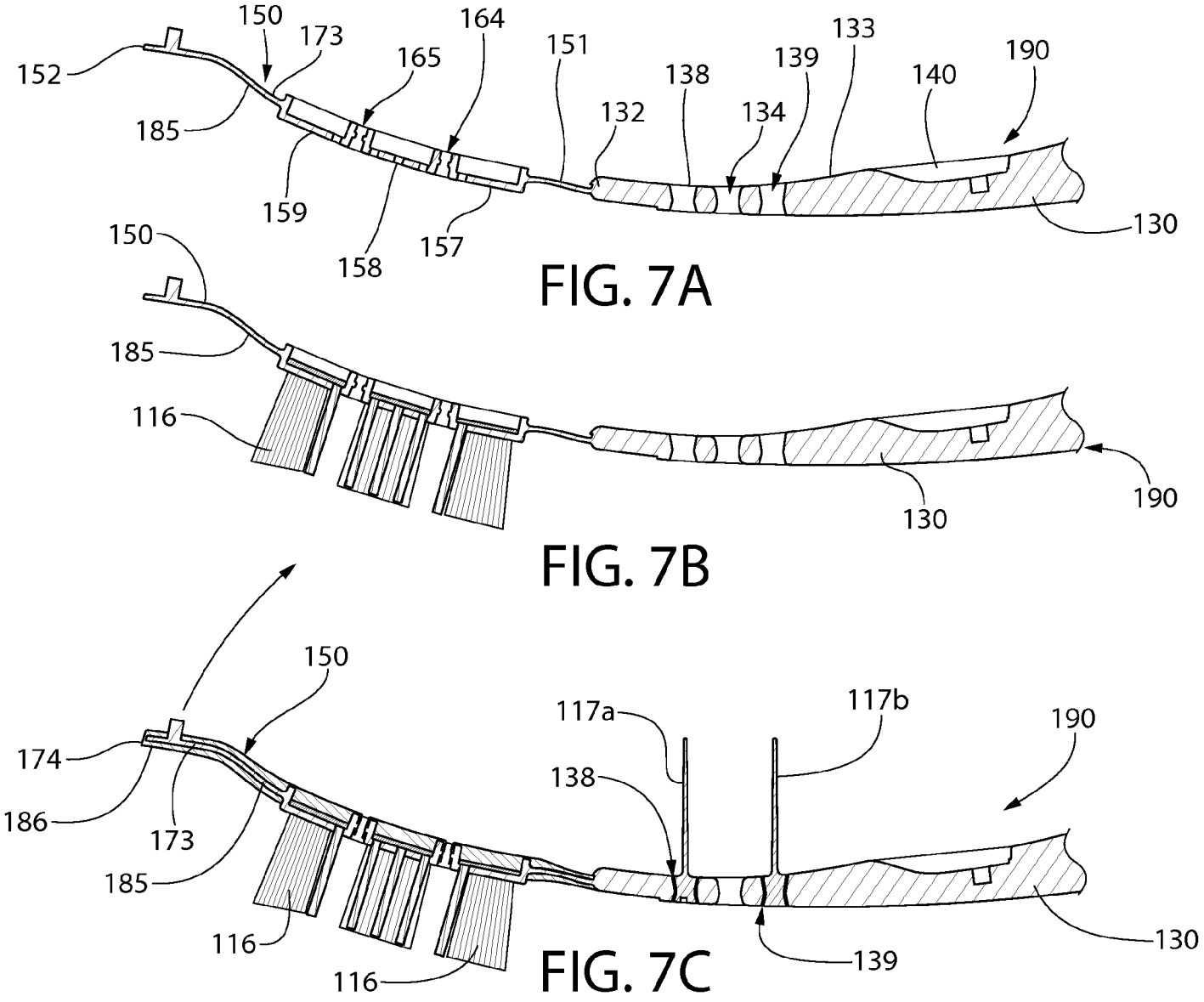
FIGS. 7A-7F collectively illustrate a method of forming the oral care implement of FIG. 1.

Referring now to FIGS. 7A-7F, a method of forming the oral care implement 100 will be described. Referring first to FIG. 7A, in a first step a body 190 (which forms the head 120 of the oral care implement 100) comprising the base 130 and a first portion 185 of the resilient bridge 150 is formed. The first portion 185 of the resilient bridge 150 may comprise or be formed of the first component 173 described above. Thus, in this embodiment the base 130 and the first portion 185 of the resilient bridge 150 are integrally formed as a monolithic structure. Furthermore, in certain embodiments the entire handle 110 may also be formed integrally with the first portion 185 of the resilient bridge 150 and the base 130 as a monolithic structure. Specifically, the body 190 is a monolithic structure that may comprise the base 130 and the first portion 185 of the resilient bridge 150 and may also comprise the handle 110.

The first end 151 of the first portion 185 of the resilient bridge 150 extends from the distal end 132 of the base 130. The first portion 185 of the resilient bridge 150 terminates in a free end, which is the second end 152 of the resilient bridge 150 as described above. The body 190 may be formed via a first injection molding step in a first mold cavity. Specifically, a molten plastic material may be injected into a first mold cavity having the shape of the body 190 to thereby form the body 190. Thus, as described earlier, the base 130 and the resilient bridge 150, or at least the first portion 185 of the resilient bridge 150, may be formed integrally in a single mold cavity. Of course, the invention is not to be so limited in all embodiments and in other embodiments the base 130 and the first portion 185 of the resilient bridge 150 may be formed as separate elements in separate injection molding or other process and then later coupled together using techniques readily available to persons skilled in the art. However, for ease of manufacturing and reducing costs, forming the base 130 and the first portion 185 of the resilient bridge 150 as a monolithic structure may be desirable.

The base 130 at this stage of formation includes the aperture 134 as well as first and second cleaning element holes 138, 139. The first and second cleaning element holes 138, 139 are the holes into which the first and second fixed tooth cleaning elements 117*a*, 117*b* are mounted to couple the first and second fixed tooth cleaning elements 117*a*, 117*b* to the base 130, as described below with reference to FIG. 7C. In the exemplified embodiment, the first and second cleaning element holes 138, 139 are positioned on opposing sides of the aperture 134 in the direction of the longitudinal axis A-A of the head 120. The base 130 also includes a recess 140 formed into the upper surface 133 of the base 130 that provides a region on the base 130 for attachment of the second end 152 of the resilient bridge 150. This recess 140 may be formed into the handle 110 instead of the base 130 in other embodiments.

The resilient bridge 150 includes the first, second, and third carriers 157, 158, 159. Furthermore, the first and second apertures 164, 165 are formed into the resilient bridge 150 and located between the first and second carriers 157, 158 and the second and third carriers 158, 159, respectively.

Referring to FIG. 7B, in the next step of the formation process, the movable tooth cleaning elements 116 are coupled to the first, second, and third carriers 157-159 of the resilient bridge 150 by inserting the movable cleaning elements 116 into tuft holes (not illustrated) formed into the carriers 157-159. In certain embodiments, this is accomplished via an AFT technique as described above, whereby the movable tooth cleaning elements 116 are inserted into openings in the first, second, and third carriers 157-159 and then heat is applied to the bottoms of the movable tooth cleaning elements 116 to form a melt matte that couples the movable tooth cleaning elements 116 to the first, second, and third carriers 157-159. The melt matte prevents the movable tooth cleaning elements 116 from being pulled back through the tuft holes in the carriers 157-159. Alternatively, the movable tooth cleaning elements 116 may be coupled to the resilient bridge 150 using staple technology or any of the other technologies listed herein above.

Referring to FIG. 7C, after the movable tooth cleaning elements 116 are coupled to the resilient bridge 150, the body may be positioned in a second mold cavity whereby a second injection molding process takes place to form the structure illustrated in FIG. 7C. Of course, in some embodiments the second injection molding process may take place before the movable tooth cleaning elements 116 are coupled to the resilient bridge 150. In the second injection molding process, a second molten plastic is injection molded such that the second component 174 of the resilient bridge 150 is molded atop of the first component 173 of the resilient bridge 150. The second component 174 of the resilient bridge 150 may form a second portion 186 of the resilient bridge 150. The second component 174 in the exemplified embodiment covers the melt matte of the movable tooth cleaning elements 116 to fixedly secure the movable tooth cleaning elements 116, to the first, second, and third carriers 157-159.

Furthermore, FIG. 7C illustrates the first and second fixed tooth cleaning elements 117*a*, 117*b* mounted within the first and second cleaning elements holes 138, 139 of the base 130. The first and second fixed tooth cleaning elements 117*a*, 117*b* may be molded into the first and second cleaning element holes 138, 139 directly. Of course, the invention is not to be limited to forming the first and second fixed tooth cleaning elements 117*a*, 117*b* via injection molding directly into the holes 138, 139. In some embodiments, the first and second fixed tooth cleaning elements 117*a*, 117*b* may be formed separately from the body 190 and then affixed to the base 130 of the body 190 by inserting the fixed tooth cleaning elements 117*a*, 117*b* into the holes 138, 139. In such an embodiment, the first and second fixed tooth cleaning elements 117*a*, 117*b* may be fixed to the base 130 of the body 190 either via mechanical means (interference fit, tight fit, fasteners, adhesion, etc.) or via the injection molding described herein above. Furthermore, it should be appreciated that in some embodiments the first and second fixed tooth cleaning elements 117*a*, 117*b* may not be mounted to the base 130 until after the resilient bridge 150 is bent/folded over the base 130 as illustrated in FIGS. 7D-7F and discussed below.

Figure 7E:
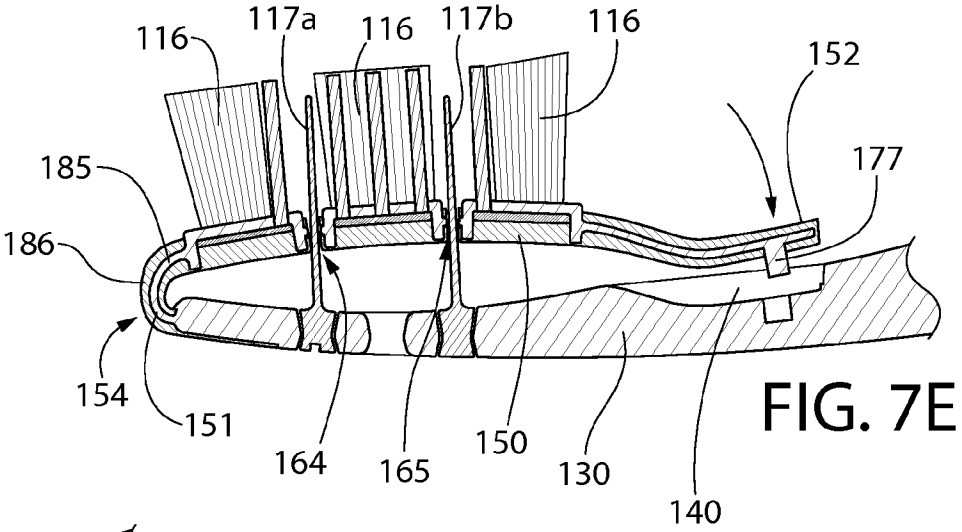
Figure 7D:
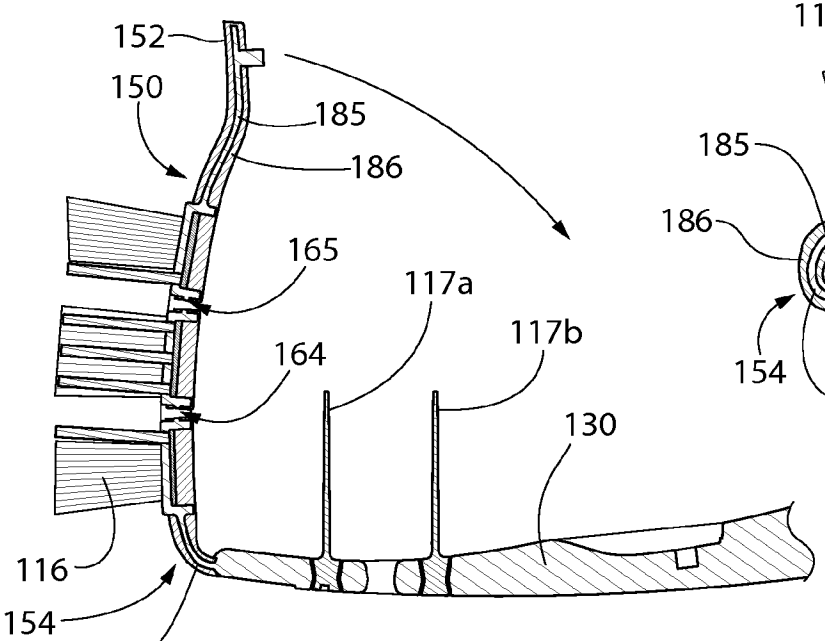

Referring to FIG. 7D, in order to form the head 120, the resilient bridge 150 is bent towards a proximal end of the base 130 and towards the handle 110. Specifically, the terminal end 152 of the resilient bridge 150 is pulled in a clockwise direction towards the proximal end of the base 130. State another way, the resilient bridge 150 is folded over the base 130 about the first end 151 of the resilient bridge 150, which ends up forming the distal-most end of the head 120. Specifically, the bending of the resilient bridge 150 causes the first end 151 of the resilient bridge 150 to bend into the U-shaped distal section 154 of the resilient bridge 150.

Figure 7F:
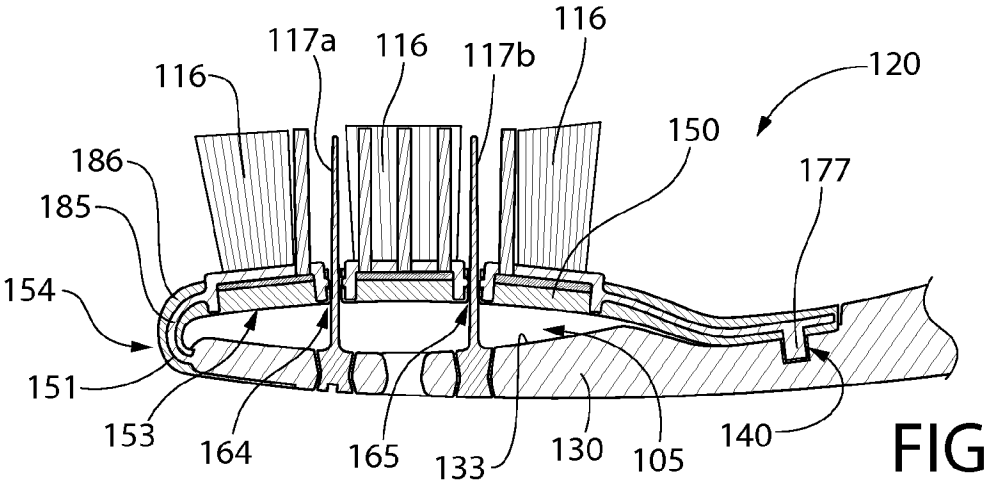

Referring to FIGS. 7E and 7F, the resilient bridge 150 continues to be bent until the first and second fixed tooth cleaning elements 117*a*, 117*b* extend through the first and second apertures 164, 165, respectively and until a connection feature 177 adjacent the second end 152 of the resilient bridge 150 enters into the recess 140. Once in this position, the connection feature 177 may be ultrasonically welded or otherwise (adhesion, fasteners, tight fit, threaded engagement, or the like) fixedly coupled to the base 130 within the recess 140. Thus, the final step in the process of forming the oral care implement 100 is coupling the free end 152 of the resilient bridge 150 to a proximal end of the base 130, which thereby forms the head 120 of the oral care implement 100. As discussed in detail below, upon completion of formation of the head 120 of the oral care implement 100, the gap 105 exists between the lower surface 153 of the resilient bridge 150 and the upper surface 133 of the base 130, and the resilient bridge 130 is under flexure stress.

Figure 8:
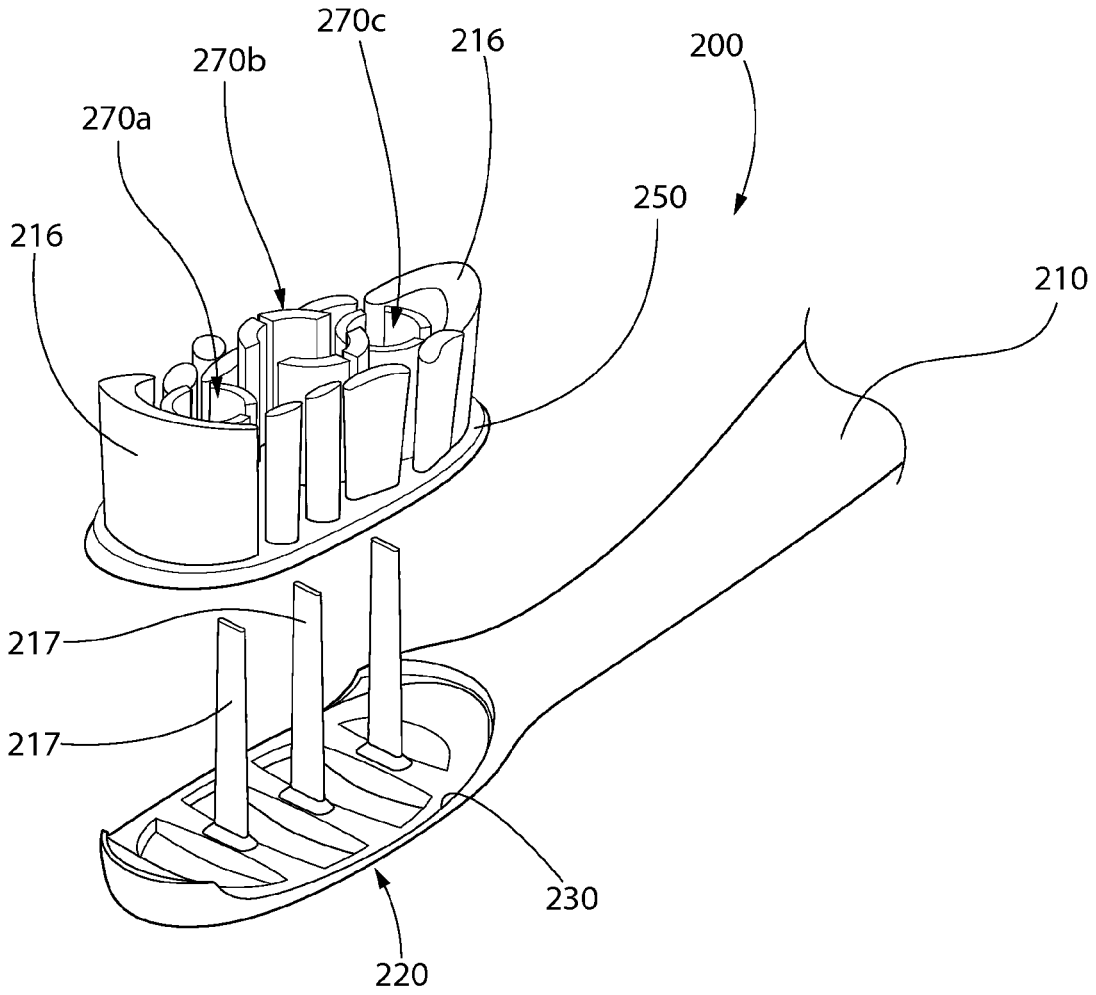
FIG. 8 is an exploded perspective view of an oral care implement in accordance with a first alternative embodiment of the present invention.
Figure 9:
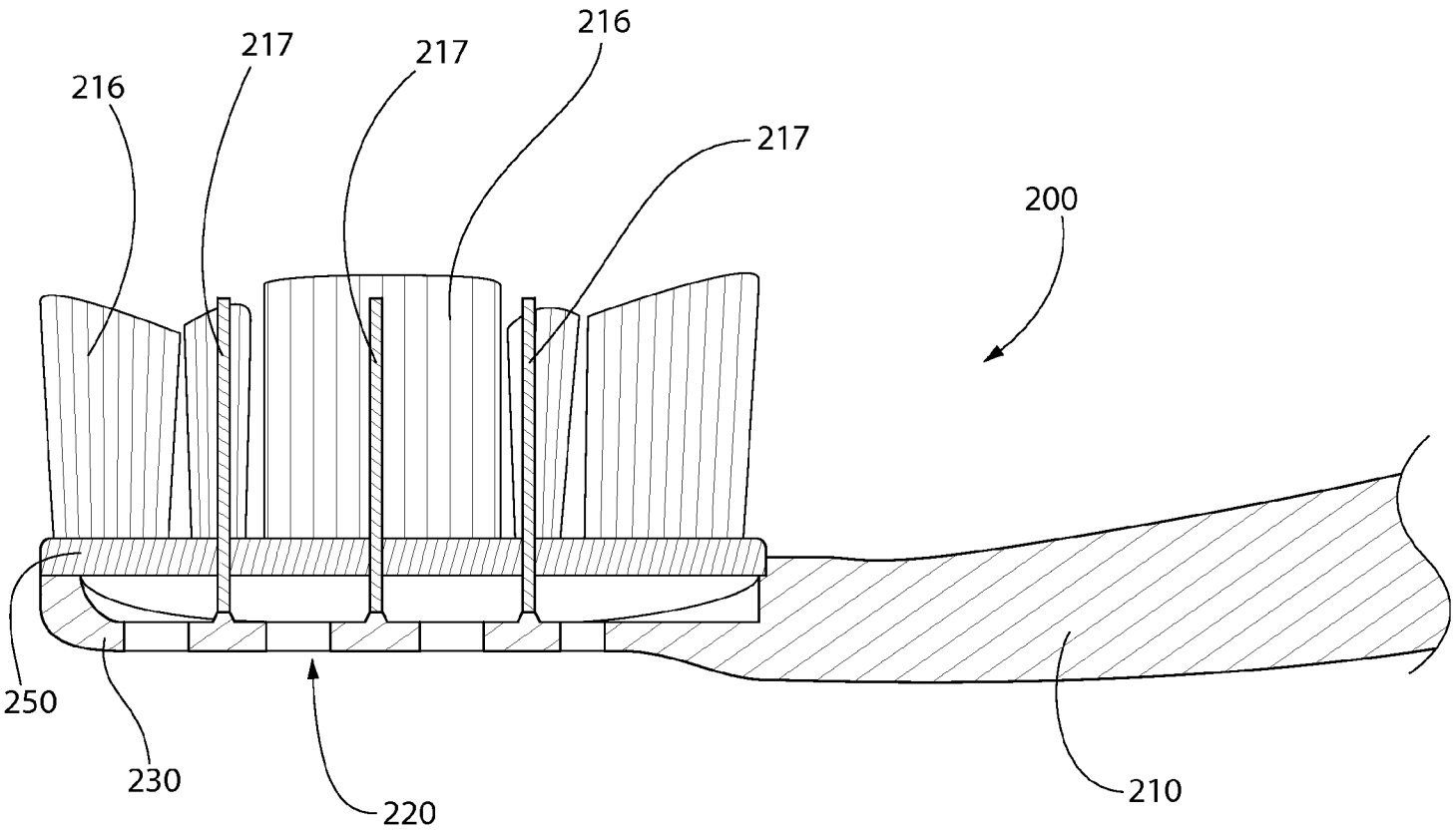
FIG. 9 is a schematic cross-sectional view taken longitudinally through the oral care implement of FIG. 8 when assembled, wherein a resilient bridge of a head of the oral care implement is in a normal state.
Figure 10:
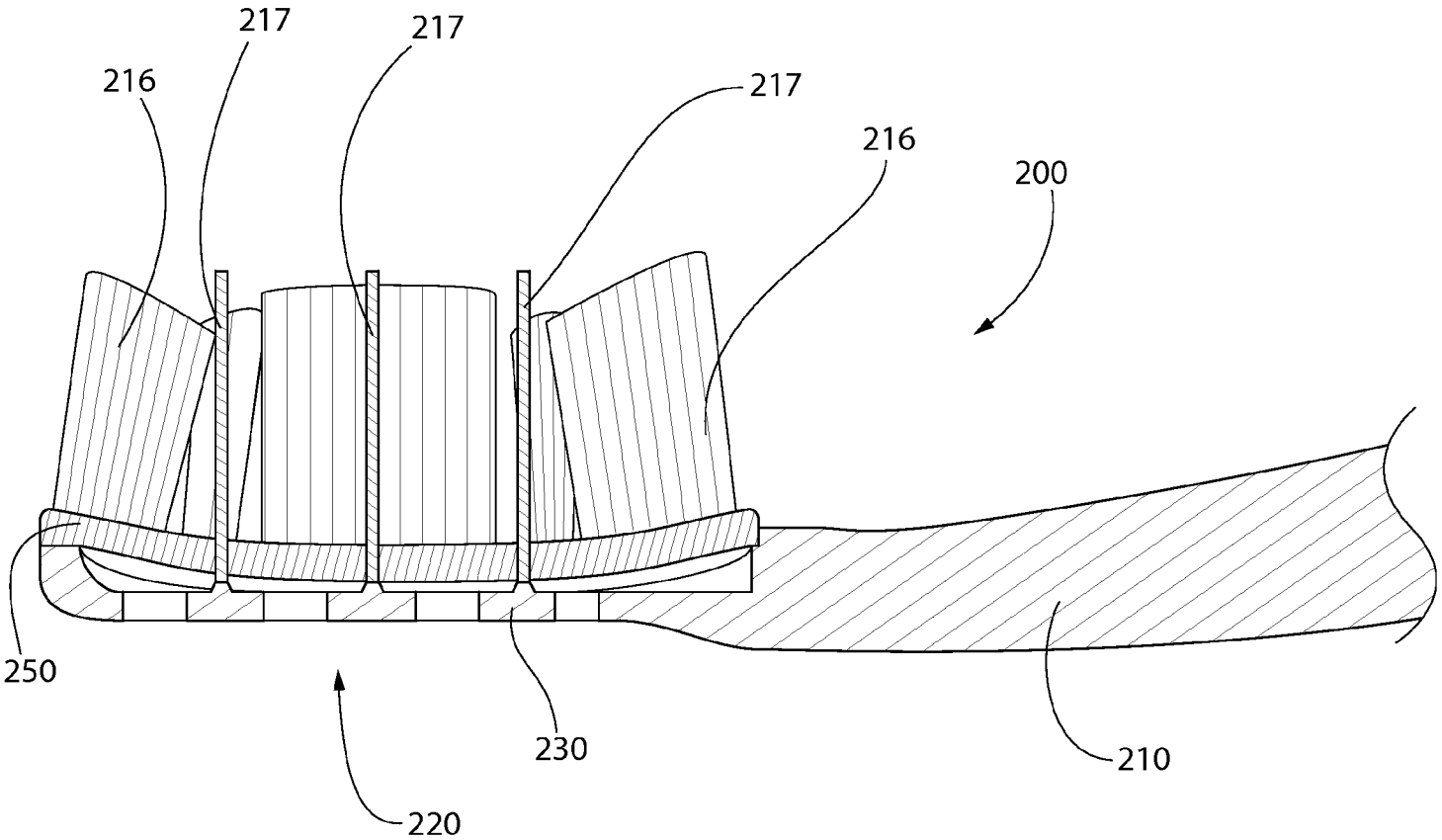
FIG. 10 is a schematic cross-sectional view taken longitudinally through the oral care implement of FIG. 8 when assembled, wherein the resilient bridge of the head of the oral care implement is in a flexed state.

Referring briefly to FIG. 8-10 concurrently, another embodiment of an oral care implement 200 will be described. The oral care implement 200 is similar to the oral care implement 100 and thus similar numbering will be used except that the 200-series of numbers will be used. Certain features that are in both the oral care implements 100, 200 will not be described with reference to the oral care implement 200 in the interest of brevity, it being understood that the description of the oral care implement 100 set forth above is applicable.

The oral care implement 200 generally comprises a handle 210 and a head 220. The head comprises a base 230 and a resilient bridge 250. A plurality of fixed tooth cleaning elements 217 are coupled directly to the base 230. In this embodiment, the resilient bridge 250 is formed completely separately from the base 230 and is later coupled thereto. Thus, as exemplified, the resilient bridge 250 is in the form of a head plate that is coupled to the base 230. A plurality of movable tooth cleaning element 216 are mounted to and extend from the resilient bridge 250.

The resilient bridge 250 may be coupled to the base 230 using techniques known in the art, including without limitation welding (ultrasonic or otherwise), adhesion, fasteners, interference fit, or the like. In the exemplified embodiment, the resilient bridge 250 is welded to the base 230 to fixedly couple the resilient bridge 250 to the base 230.

Referring to FIGS. 9 and 10 concurrently, when the resilient bridge 250 is coupled to the base 230, a gap 205 is formed between the lower surface of the resilient bridge 250 and the upper surface of the base 230. Furthermore, when the resilient bridge 250 is coupled to the base 230, the fixed tooth cleaning elements 217 extend through openings in the resilient bridge 250. The resilient bridge 250 is adjustable or flexible between a normal state, illustrated in FIG. 9, and a flexed state, illustrated in FIG. 10. The resilient bridge 250 may be biased into the normal state. In the flexed state, upon application of a force onto the resilient bridge 250, a portion of the resilient bridge 250 flexes into the gap 105 towards the base 230. Thus, the fixed tooth cleaning elements 217 extend further from an upper surface of the resilient bridge 250 when the resilient bridge 250 is in the flexed state than when the resilient bridge 250 is in the normal state.

Referring again to FIG. 8, in this embodiment the movable tooth cleaning elements 216 form at least three different loops 270*a*, 270*b*, 270*c* along the longitudinal axis of the head 220. Each of the loops 270*a*, 270*b*, 270*c* defines a cavity, and each of the fixed tooth cleaning elements 217 extends into the cavity of one of the loops 270*a*, 270*b*, 270*c*. The central loop 270*b* extends a greater height from the resilient bridge 250 than the outer loops 270*a*, 270*c*. In certain embodiments, the fixed tooth cleaning elements 217 within the outer loops 270*a*, 270*c* may extend a greater height than the outer loops 270*a*, 270*c* within which they are positioned when the resilient bridge 250 is in the normal state and the fixed tooth cleaning element 217 within the central loop 270*b* may extend a height less than the central loop 270*b* within which it is positioned when the resilient bridge 250 is in the normal state. Forming the central loop 270*b* to be taller than the other tooth cleaning elements may be desirable in that the force of brushing will be applied to the central loop 270*b*, thereby effectively facilitating the flexing action of the resilient bridge 250.

Figure 11:
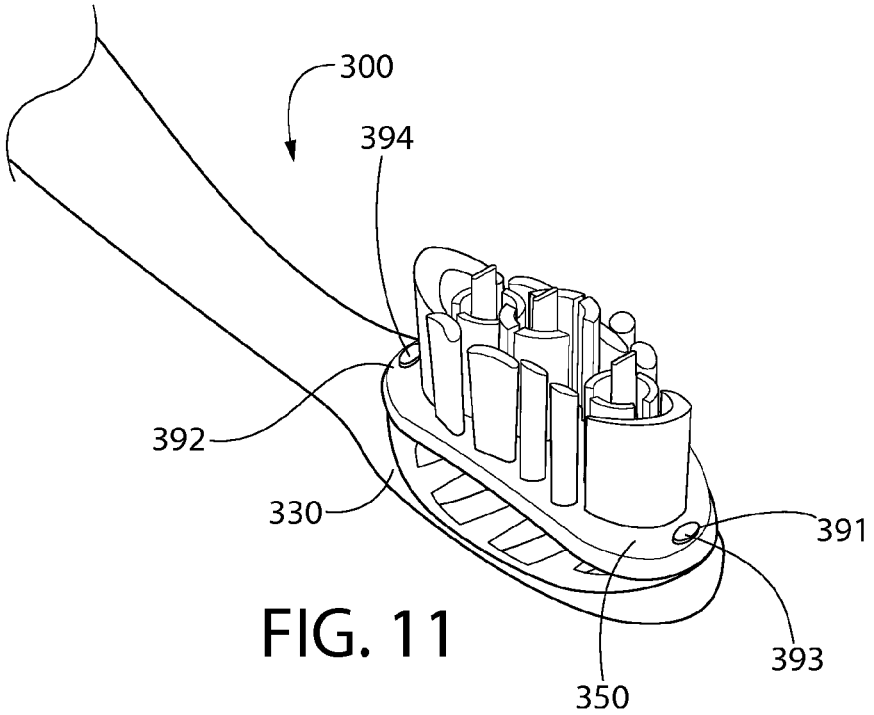
FIG. 11 is an assembled perspective view of an oral care implement in accordance with a second alternative embodiment of the present invention.
Figure 12:
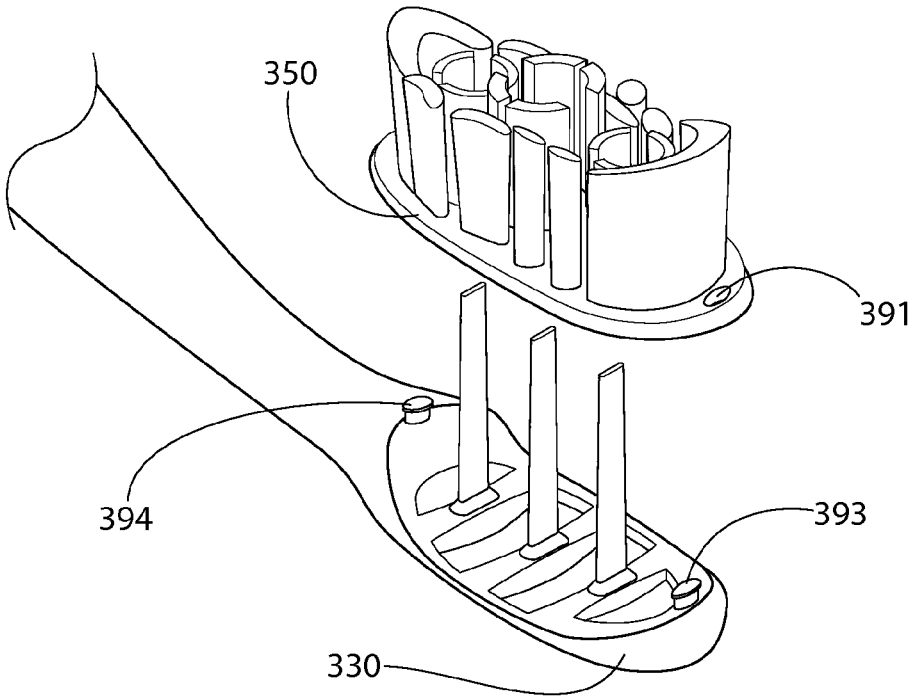
FIG. 12 is an exploded perspective view of the oral care implement of FIG. 11.

Referring to FIGS. 11 and 12, an oral care implement 300 will be described in accordance with an embodiment of the present invention. The oral care implement 300 is generally identical to the oral care implement 200 except as described herein below. Therefore, in the interest of brevity it will be understood that the description of the oral care implement 200 (and the oral care implement 100 where applicable) above is also applicable to the oral care implement 300. Similar numbering will be used except that the 300-series of numbers will be used. It should be appreciated that for numbers used and not described in FIGS. 11 and 12, the description of the similar feature with the similar numeral on the oral care implements 100, 200 applies.

In this embodiment, the only difference between the oral care implement 300 relative to the oral care implement 200 is the manner in which the resilient bridge 350 is coupled to the base 330. Specifically, in this embodiment the resilient bridge 350 has apertures 391, 392 on its opposing first and second ends. Furthermore, the base 330 has protuberances 393, 394 on its opposing first and second (or proximal and distal) ends. The resilient bridge 350 is coupled to the base 330 by inserting the protuberances 393, 394 of the base 330 into a respective one of the apertures 391, 392 in the resilient bridge 350. Of course, the protuberances could be on the resilient bridge 350 and the apertures could be on the base 330 in an alternative embodiment. Thus, this exemplifies one embodiment in which the resilient bridge 350 is separately formed from the base 330 and the two components may be mechanically coupled together.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle and extending along a longitudinal axis, the head comprising:

a base;

a resilient bridge flexible between: (1) a normal state in which the resilient bridge comprises a bowed section that is bowed away from the base so that a gap exists between a lower surface of the resilient bridge and an upper surface of the base; and (2) a flexed state in which the bowed section of the resilient bridge is moved toward the base and into the gap; and the resilient bridge being self-biased into the normal state, and wherein in the normal state, the bowed section of the resilient bridge is under flexure stress;

a plurality of movable tooth cleaning elements mounted to the resilient bridge and extending from an upper surface of the resilient bridge; and a first fixed tooth cleaning element mounted to the base and having a free end, the first fixed tooth cleaning element extending through a first aperture in the resilient bridge;

wherein the resilient bridge comprises a first component and a second component formed of a resilient material, the first component and the base being an integrally formed monolithic component, the second component of the resilient bridge surrounding the first component of the resilient bridge, the resilient bridge comprising a connection feature extending through the second component on a lower surface of the resilient bridge at a second end of the resilient bridge; and wherein one of the handle or the base has a recess formed therein, the recess receiving the connection feature and a portion of the second component of the resilient bridge which surrounds the connection feature on the lower surface of the resilient bridge.

2. The oral care implement according to claim 1 wherein the bowed section of the resilient bridge comprises a distal-most carrier section and a proximal-most carrier section; a distal-most group of the movable tooth cleaning elements mounted to the distal-most carrier section and a proximal-most group of the movable tooth cleaning elements mounted to the proximal-most carrier section; and wherein the gap extends beneath the entirety of each of the distal-most carrier section and the proximal-most carrier section.

3. The oral care implement according to claim 1 further comprising:

the first aperture formed into the bowed section of the resilient bridge, the first aperture extending through the resilient bridge from the lower surface of the resilient bridge to the upper surface of the resilient bridge;

wherein in the normal state, the free end of the first fixed tooth cleaning element is located a first height above the upper surface of the resilient bridge; and wherein in the flexed state, the free end of the first fixed tooth cleaning element is located a second height above the upper surface of the resilient bridge, the second height being greater than the first height.

4. The oral care implement according to claim 3 wherein a tallest one of the plurality of movable bristles has a third height measured from the upper surface of the resilient bridge to a free end of the tallest one of the plurality of movable bristles, wherein the second height is greater than the third height.

5. The oral care implement according to claim 3 further comprising:

the bowed section of the resilient bridge comprising a second aperture extending through the resilient bridge from the lower surface of the resilient bridge to the upper surface of the resilient bridge;

a second fixed tooth cleaning element mounted to the base and having a free end, the second fixed tooth cleaning element extending through the second aperture;

wherein in the normal state, the free end of the second fixed tooth cleaning element is located a fourth height above the upper surface of the resilient bridge; and wherein in the flexed state, the free end of the second fixed tooth cleaning element is located a fifth height above the upper surface of the resilient bridge, the fifth height being greater than the fourth height.

6. The oral care implement according to claim 5 wherein the first and second fixed tooth cleaning elements are located on the longitudinal axis and spaced apart from one another.

7. The oral care implement according to claim 6 wherein the plurality of movable tooth cleaning elements comprises a first group of movable tooth cleaning elements, a second group of movable tooth cleaning elements, and a third group of movable tooth cleaning elements; and wherein the first aperture is located between the first and second groups of movable tooth cleaning elements and the second aperture is located between the second and third groups of tooth cleaning elements.

8. The oral care implement according to claim 7 wherein the resilient bridge comprises a first carrier section, a second carrier section, and a third carrier section; the first carrier section coupled to a first end of the second carrier section via a first flexible transverse hinge; the third carrier section coupled to a second end of the second carrier section via a second flexible transverse hinge, the second end of the second carrier section being opposite the first end of the second carrier section; wherein the first aperture is located in the first flexible transverse hinge and the second aperture is located in the second flexible transverse hinge; and wherein the first group of movable tooth cleaning elements is mounted to the first carrier section, the second group of movable tooth cleaning elements is mounted to the second carrier section, and the third group of movable tooth cleaning elements is mounted to the third carrier section.

9. The oral care implement according to claim 8 wherein in the normal state, a lower surface of each of the first, second, and third carrier sections are spaced from the upper surface of the base by the gap.

10. The oral care implement according to claim 3 wherein the plurality of movable tooth cleaning elements comprises a loop of the movable tooth cleaning elements collectively defining a central cavity having a floor; and wherein the first aperture is located on the floor of the central cavity such that the first fixed tooth cleaning element extends into the central cavity.

11. The oral care implement according to claim 10 wherein the loop of the movable tooth cleaning elements has a sixth height measured from the upper surface of the resilient bridge to a free end of the loop of movable tooth cleaning elements, the sixth height being greater than the first height and less than the second height.

12. The oral care implement according to claim 1 wherein the gap forms a transverse passageway that extends through the head from a first peripheral outer surface of the head to a second peripheral outer surface of the head, the second peripheral outer surface located opposite the first peripheral outer surface.

13. The oral care implement according to claim 1 wherein the resilient bridge comprises a U-shaped distal section, a middle section, and a proximal section, the U-shaped distal section comprising the first end of the resilient bridge and defining a distal-most peripheral outer surface of the head that is free of an overhang.

14. The oral care implement according to claim 1 wherein the first component is formed of a first material and the second component is formed of a second material, the first material being different than the second material.

15. An oral care implement comprising:

a handle;

a head coupled to the handle, the head comprising:

a base;

a resilient bridge coupled to the base and supported above the base, the resilient bridge flexible between: (1) a normal state in which a gap exists between a lower surface of the resilient bridge and an upper surface of the base; and (2) a flexed state in which a portion of the resilient bridge is moved toward the base and into the gap;

a loop of movable tooth cleaning elements mounted to the portion of the resilient bridge and extending from an upper surface of the resilient bridge, the loop of movable tooth cleaning elements collectively defining a central cavity having a floor, a first aperture in the floor extending through the resilient bridge from the lower surface of the resilient bridge to the upper surface of the resilient bridge; and a first fixed tooth cleaning element mounted to the base and having a free end, the first fixed tooth cleaning element extending through the first aperture and into the central cavity;

wherein the resilient bridge comprises a first component and a second component formed of a resilient material, the first component and the base being an integrally formed monolithic component, the second component of the resilient bridge surrounding the first component of the resilient bridge, the resilient bridge comprising a connection feature extending through the second component on a lower surface of the resilient bridge at a second end of the resilient bridge; and wherein one of the handle or the base has a recess formed therein, the recess receiving the connection feature and a portion of the second component of the resilient bridge which surrounds the connection feature on the lower surface of the resilient bridge.

16. The oral care implement according to claim 15 wherein the resilient bridge comprises a U-shaped distal section, a middle section, and a proximal section, the U-shaped distal section defining a distal-most peripheral outer surface of the head that is free of an overhang.

17. The oral care implement according to claim 15 wherein in the normal state, the free end of the first fixed tooth cleaning element is located a first height above the upper surface of the resilient bridge; and wherein in the flexed state, the free end of the first fixed tooth cleaning element is located a second height above the upper surface of the resilient bridge, the second height being greater than the first height.

18. The oral care implement according to claim 15 wherein the first fixed tooth cleaning element is an interdental element having a transverse cross-sectional area that tapers moving from the base toward the free end of the first fixed tooth cleaning element.

19. An oral care implement comprising:

a handle;

a head coupled to the handle and extending along a longitudinal axis, the head comprising:

a base having a proximal end coupled to a distal end of the handle and a distal end;

a resilient bridge comprising:

at least one carrier section;

a curved portion having a convex outer surface, a concave inner surface, a lower end coupled to the distal end of the base and an upper end coupled to the at least one carrier section;

a second end coupled to the distal end of the handle;

the resilient bridge flexible between: (1) a normal state in which a gap exists between a lower surface of the resilient bridge and an upper surface of the base; and (2) a flexed state in which the curved portion is deformed such that a portion of the resilient bridge is moved toward the base and into the gap; and a plurality of movable tooth cleaning elements mounted to the at least one carrier section of the resilient bridge and extending from an upper surface of the resilient bridge;

wherein the resilient bridge comprises a first component and a second component formed of a resilient material, the first component and the base being an integrally formed monolithic component, the second component of the resilient bridge surrounding the first component of the resilient bridge, the resilient bridge comprising a connection feature extending through the second component on a lower surface of the resilient bridge at a second end of the resilient bridge; and wherein one of the handle or the base has a recess formed therein, the recess receiving the connection feature and a portion of the second component of the resilient bridge which surrounds the connection feature on the lower surface of the resilient bridge.

20. The oral care implement according to claim 19 wherein the curved section comprises a curved beam formed of a first material and an outer layer encasing the curved beam, the outer layer formed of a second material, the first material being harder than the second material.

* * * * *